US006275673B1

(12) United States Patent
Yoshii et al.

(10) Patent No.: US 6,275,673 B1
(45) Date of Patent: Aug. 14, 2001

(54) PHOTOSENSITIVE UNIT, LIGHT SOURCE AND IMAGE FORMING APPARATUS

(75) Inventors: Tomoyuki Yoshii; Yasuhiro Funayama; Takeshi Hori; Tsutomu Uezono, all of Tokyo (JP)

(73) Assignee: NEC Corporation, Tokyo (JP)

( * ) Notice: Subject to any disclaimer, the term of this patent is extended or adjusted under 35 U.S.C. 154(b) by 0 days.

(21) Appl. No.: 09/527,365

(22) Filed: Mar. 17, 2000

(30) Foreign Application Priority Data

Mar. 18, 1999 (JP) ..... 11-074566

(51) Int. Cl.[7] ..... G03G 15/00; G03G 15/04

(52) U.S. Cl. ..... 399/159; 347/55; 347/134; 347/241; 399/152

(58) Field of Search ..... 399/152, 154, 399/159, 161, 220, 221; 347/55, 141, 118, 134, 238, 241, 256; 430/55, 126

(56) References Cited

U.S. PATENT DOCUMENTS 4,578,615 * 3/1986 Genovese et al. ..... 313/497
5,016,040 * 5/1991 Dwyer, III ..... 355/20
5,552,863 * 9/1996 Genovese ..... 399/152
5,579,161 * 11/1996 Sekiguchi ..... 359/559
5,815,774 9/1998 Funayama et al. ..... 399/159

FOREIGN PATENT DOCUMENTS 9-204092 8/1997 (JP) .
11-149164 6/1999 (JP) .

* cited by examiner

*Primary Examiner*—Sophia S. Chen
(74) *Attorney, Agent, or Firm*—Scully, Scott, Murphy & Presser

(57) ABSTRACT

A porous photosensitive unit has a transparent conductive layer formed on a surface of a transparent substrate. A photoconductive layer is formed on a surface of the transparent conductive layer. A porous insulating layer formed on a surface of the photoconductive layer has a plurality of holes for holding conductive color particles. The plurality of holes includes a first hole and the adjacent second and third holes. An upper or screen electrode is formed on a surface of the porous insulating layer except where the holes are formed. The photosensitive unit includes an optical arrangement in which, when a light source emits light to cause conductive color particles to fly out of the first hole only, the light exposes a region, within the photoconductive layer, which substantially coextends with a surface portion of the photoconductive layer that is exposed by the first hole.

33 Claims, 11 Drawing Sheets

PHOTOSENSITIVE UNIT, LIGHT SOURCE AND IMAGE FORMING APPARATUS

BACKGROUND OF THE INVENTION

1. Field of the Invention

The present invention relates to a photosensitive unit, a light source, and an image forming apparatus for use in a copying machine, a printer and a facsimile.

2. Description of the Related Art

Known, as a conventional image forming process, is an electrophotography. A representative example is a Carlson process or xerography. According to xerography, a resinous powder forms on an electrically charged plate an image, and this image is transferred and thermally fixed onto a paper. This image recording technique requires six processes, which include charging, exposing, developing, transferring, fixing, and cleaning. Each of such processes requires its own unit, resulting in a bulky machine.

U.S. Pat. No. 5,815,774 (=JP-A 9-204092) issued to Funayama et al. discloses a simplified process alternative to the Carlson process. This simplified process uses a porous photosensitive unit (PPU). The PPU includes a transparent substrate, a transparent conductive layer formed over the substrate, and a photoconductive layer formed over the transparent conductive layer. The PPU also includes a porous insulating layer formed over the photoconductive layer. The porous insulating layer has a screen or an upper electrode formed over the surface thereof. Conductive color particles that are charged to one polarity are attracted to the PPU to fill holes of the porous insulating layer. Subsequently, when a light corresponding to an image is irradiated to the photoconductive layer of the PPU, the color particles within an area exposed to the light are charged to the opposite polarity. These color particles are transferred to a recording medium, forming the image thereon.

Referring to FIG. 13, a description is made on the image recording technique disclosed in the above-mentioned U.S. Pat. No. 5,815,774. FIG. 13 illustrates the principle of the image recording technique.

The image recording technique requires processes, which include color particles filling, exposing and transferring, and fixing. Hereinafter, a description is made on the exposing and transferring process.

In FIG. 13, the reference numeral 11 generally designates holes of a porous insulating layer 4 of a PPU 10, namely, first, second and third holes 11*a,* 11*b,* and 11*c.* As illustrated, the minute holes 11*a,* 11*b,* and 11*c* are filled with conductive color particles that have been fed thereto during color particles filling process.

A light source illuminates in a pattern corresponding to data to be printed. Light 9 from the light source passes through a transparent substrate 1 and a transparent conductive layer 2 to reach a photoconductive layer 3, exposing a region 7, called "exposed region, " of the photoconductive layer 3 in the pattern corresponding to the data to be printed. Electric charges are induced within the exposed region 7, only. An upper electrode 5 above the porous insulating layer 4 is held at a predetermined negative potential for attracting positive electric charges 8 induced by the light irradiation. Thus, among the electric charges inducted by the light irradiation, positive electric charges move toward the surface of the photoconductive layer 3 for injection into the negatively charged color particles 6 that are received in the holes 11. The negatively charged color particles 6 are neutralized and then positively charged. The transparent conductive layer 2 is held at a predetermined positive potential to neutralize the negatively charged particles that have been induced due to the light irradiation. As a result, an electric repulsion force is generated between the positively charged color particles 6 and the transparent conductive layer 2, causing the color particles 6 to fly out of the holes 11. The color particles 6 that have flown are attached by adhesion to a recording medium to form an image of the data to be printed. This image is fixed during the subsequent fixing process.

According to the image recording technique, color particles filling process, exposing and transferring process, and fixing process complete an image recording. Making it possible to construct a compact machine. Since a light source as used in ordinary electrophotography may be used, the conventional technology is advantageous in cost.

SUMMARY OF THE INVENTION

The Applicants have made studies from various aspects to improve the above-mentioned conventional technology. These studies have revealed a problem as follows. According to the conventional image recording technology, transferring the color particles out of one hole of the PPU forms the minimum dot. This means that the resolution of the image formed on the recording medium may be increased to a level as high as the resolution determined by the holes of the PPU. However, the actual resolution of the image is still lower than this level.

The Applicants have made further study to clarify what causes the above-mentioned problem. FIG. 14 is a schematic view illustrating the phenomena occurring in an actual machine employing the above-mentioned image recording technique. Referring to FIG. 14, a description is made on what causes the reduction in resolution.

Here, attention should be paid on the case where color particles 6 are to be transferred from the hole 11*a* of the PPU 10. If the diameter of the exposed region 7 is greater than the diameter of the hole 11*a,* electric charges are induced within a region, namely, an insulating concave portion 12, right below the portion of the porous insulating layer 4 which is not formed with the holes 11. If the exposed region 7 extends to regions right below the adjacent holes 11*b* and 11*c,* electric charges are induced also within the regions right below the holes 11*b* and 11*c.*

All of the electric charges 8 move toward the surface of the photoconductive layer 3 as indicated by arrows in FIG. 14. In the process, the electric charges 8 induced within the regions right below the adjacent holes 11*b* and 11*c* are injected into the color particles 6 located within the holes 11*b* and 11*c,* causing the color particles 6 to fly out of the holes 11*b* and 11*c.* The electric charges 8 induced within the regions right below the exposed convex portions 12 move along the surface of the photoconductive layer 3 toward the regions below the adjacent holes 11*b* and 11*c* and injected into the color particles 6 therein. This causes a flight of the color particles 6 out of the holes 11*b* and 11*c.*

Scattering of light within the transparent substrate 1 exposes regions that are not desired to be exposed, increasing the probability that color particles may fly out of holes 11 other than the desired hole 11*a.* The preceding description clearly explains that an undesired flight of color particles out of the holes 11*b* and 11*b* other than the hole 11*a* causes a reduction in resolution.

Accordingly, an object of the present invention is to provide a photosensitive unit, a source of light and an image recording apparatus, which can realize the minimum dot.

According to one aspect of the present invention, there is provided a porous photosensitive unit, comprising:

a substrate;

a conductive layer formed on a surface of said substrate;

a photoconductive layer formed on a surface of said conductive layer;

a porous insulating layer formed on a surface of said photoconductive layer, said porous insulating layer having a plurality of holes for holding conductive color particles, said plurality of holes including a first hole and the adjacent second and third holes, said plurality of holes exposing a plurality of surface portions of the surface of said photoconductive layer, respectively, so that said first, second and third holes exposing first, second and third surface portions of said plurality of surface portions, respectively;

an electrode formed on a surface of said porous insulating layer except where said plurality of holes are formed; and restrainer means whereby an optical arrangement is provided, in which, when a light source emits light to cause conductive color particles to fly out of said first hole only, said light exposes a region, within said photoconductive layer, which substantially coextends with said first surface portion.

According to another aspect of the present invention, there is provided an image forming apparatus comprising:

a porous photosensitive unit, said porous photosensitive unit including a conductive layer formed on a surface of said substrate;

a photoconductive layer formed on a surface of said conductive layer;

a porous insulating layer formed on a surface of said photoconductive layer, said porous insulating layer having a plurality of holes for holding conductive color particles, said plurality of holes exposing a plurality of surface portions of the surface of said photoconductive layer, respectively;

an electrode formed on a surface of said porous insulating layer except where said plurality of holes are formed; and restrainer means whereby an optical arrangement is provided, in which, when a light source corresponding to a desired one of said plurality of holes emits light to cause conductive color particles to fly out of said desired hole only, said light exposes a region, within said photoconductive layer, which substantially coextends with the surface portion that is exposed by said desired hole;

a plurality of light sources corresponding to said plurality of holes, respectively;

means for supplying conductive color particles to said porous photosensitive unit and holding the conductive color particles in said plurality of holes; and a recording medium;

said plurality of light sources being adapted to emit light to cause at least one of said plurality of holes to allow the conductive color particles to fly out of the hole toward said recording medium.

According to still another aspect of the present invention, there is provided a light source for an image forming apparatus operable on electrophotography, comprising:

an array including a plurality of light-emitting elements, which are subject to individual luminous controls, respectively; and a beam control element to restrict in cross sectional area and profile of a beam of light emitted by each of said plurality of light-emitting elements.

According to further aspect of the present invention, there is provided an image forming apparatus operable on a Carlson process elecrophotography, comprising:

a photoconductive unit; and a light source including an array including a plurality of light-emitting elements, which are subject to individual luminous controls, respectively, and a beam control element to restrict in cross sectional area and profile of a beam of light emitted by each of said plurality of light-emitting elements.

DESCRIPTION OF THE PREFERRED EMBODIMENT

First Preferred Implementation

Figure 1:
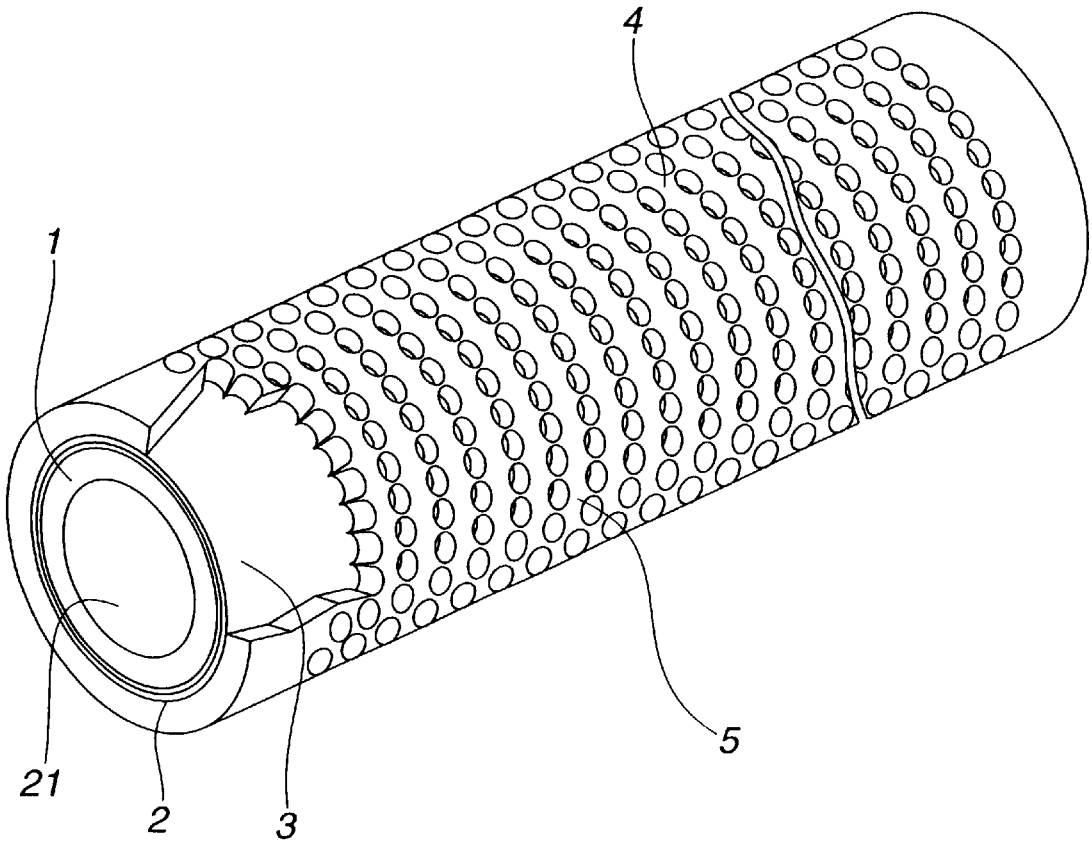
FIG. 1 is a perspective view of a porous photosensitive unit (PPU), illustrating a first preferred implementation according to the present invention.
Figure 2:
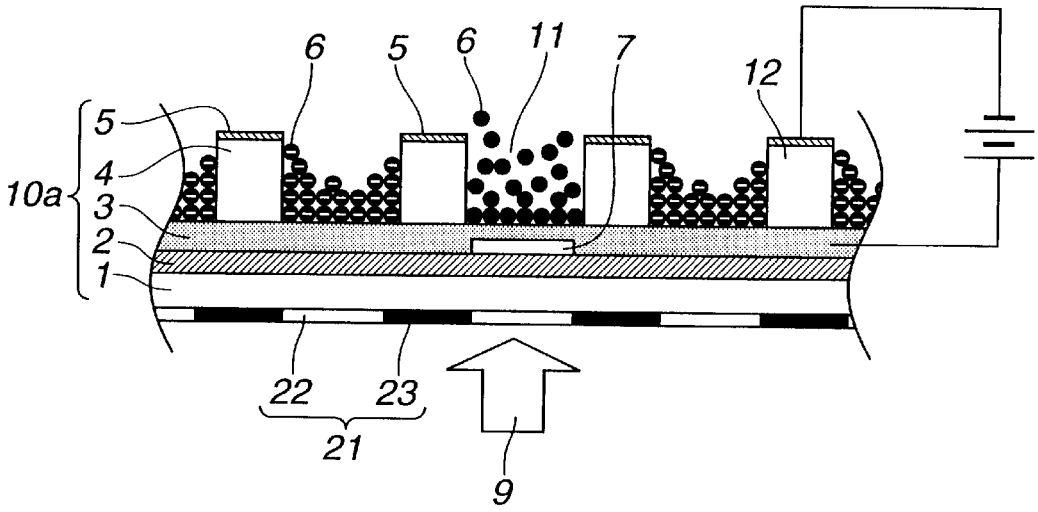
FIG. 2 is a schematic view illustrating an internal structure of and a flight of conductive color particles within the PPU.
Figure 3:
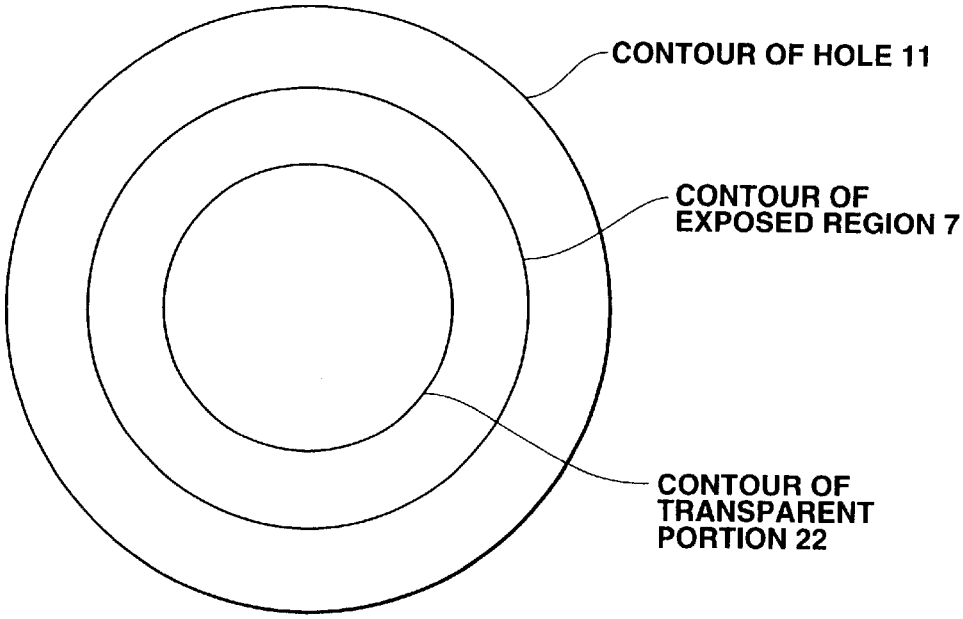
FIG. 3 is a schematic view illustrating the relationship between the contour of a hole of a porous insulating layer, the contour of a transparent portion of a masking layer, and the contour of an exposed region within a photoconductive layer.

Referring to FIGS. 1 to 3, a description is made on the first preferred implementation according to the present invention.

Figure 13:
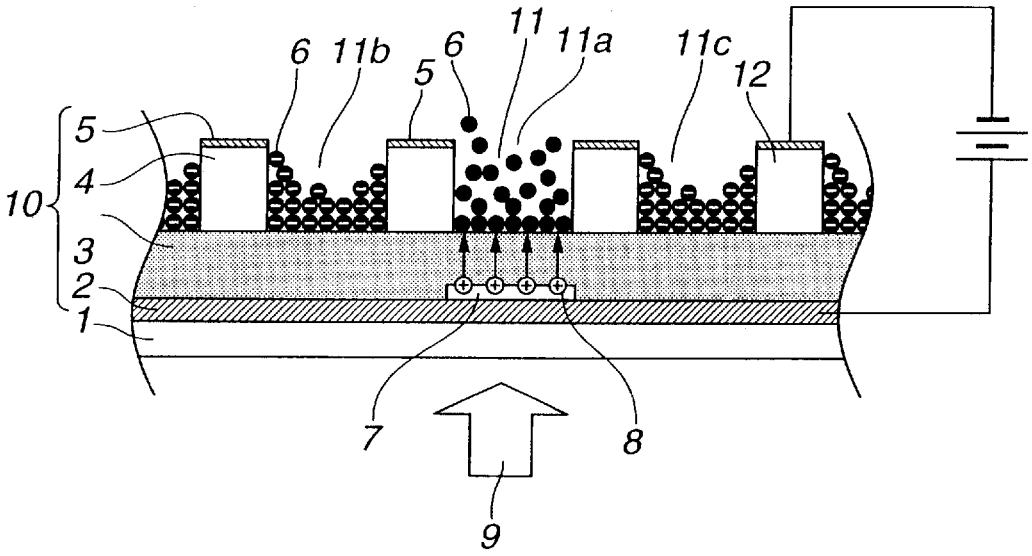
FIG.13 (PRIOR ART)
FIG. 13 is a schematic view of a portion of the conventional PPU illustrating the principle of flight of conductive color particles.
Figure 14:
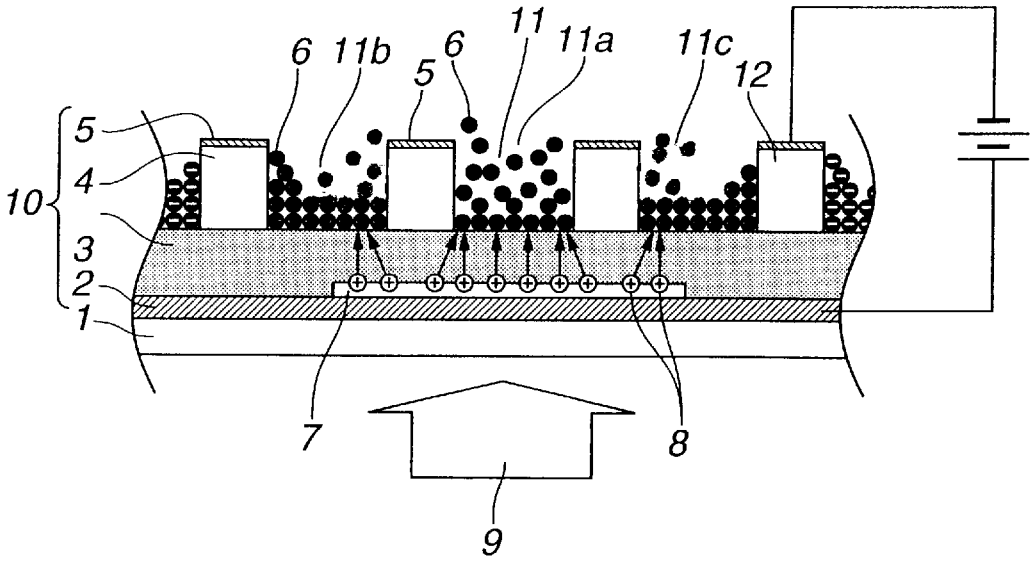
FIG.14 (PRIOR ART)
FIG. 14 is a schematic view similar to FIG. 13, illustrating the flight of conductive color particles.

This first preferred implementation is different from the prior art described in FIGS. 13 and 14 in that a PPU 10*a* has a masking layer 21 attached thereto.

As shown in FIG. 1, the PPU 10*a* comprises a cylindrical transparent substrate 1, a transparent conductive layer 2, a photoconductive layer 3, a porous insulating layer 4, and an upper electrode 5, which are stacked, in this order, on the outer peripheral surface of the cylindrical transparent substrate 1. The porous insulating layer 4 and the upper electrode 5 are formed with a plurality of equidistant through holes 11.

As shown in FIG. 2, the PPU 10*a* is equipped with a masking layer 21, which is attached to an inner peripheral surface of the transparent substrate 1. The inner peripheral surface of the transparent substrate 1 faces a light source. The masking layer 21 covers insulating protrusion 12, thus preventing the insulating protrusion 12 from being exposed to incident light from the light source. The masking layer 21 has light shading or shielding portions 23 located right below the insulating protrusion 12, respectively, and transparent portions 22 located right below the through holes 11, respectively. Within the photoconductive layer 3, the portions that are located right below the insulating protrusion 12 are light shaded by the light shading portions 23, so that they are prevented from exposure to light 9 from light source. The light transparent portions 22 provide sufficient degree of transparency. Thus, the masking layer 21 does not prevent the light 9 from exposing the portions of the photoconductive layer 3 that are located right below the holes 11.

With regard to the masking layer 21, the light shading portions 23 and the light transparent portions 22 must align with the corresponding insulating protrusion 12 and holes 11, respectively. However, the accurate alignment is not required. Holding the relationship as illustrated in FIG. 3 will suffice, thus preventing exposure of regions right below the insulating protrusions 12. FIG. 3 illustrates the preferred relationship viewing the photoconductive layer 3 in a direction of radiation of light from the light source 9. According to this relationship, the contour of each of exposed regions 7, which is projected onto the photoconductive layer 3, is in exact agreement with or located inwardly of the contour of the corresponding hole 11. To accomplish this relationship, it is preferred to arrange each of the transparent portions 22 of the masking layer 21 such that its contour matches or falls within and slightly inwardly of the contour of the corresponding hole 11.

Referring to FIG. 3, light spreads, thus explaining why the contour of the exposed region 7 falls outwardly of the contour of transparent portion 22. The fact that the contour of the exposed region 7 extends slightly beyond the contour of the corresponding hole 11 does not necessarily fail to produce the intended effect. If the light exposure of the region right below each of the insulating protrusion 12 is more or less prevented, a certain measure of the desired result can be obtained.

The shading portions 23 of the masking layer 21 are not required to cover the overall range of wavelengths of light. But, it is preferred that they cover at least wavelength of light emitted by the light source.

The masking layer 21 may be formed of a thin layer having a low transmittance over the range of wavelengths of light from the light source. For example, the masking layer 21 is made of a nontransparent resin film formed with a number of minute openings, which serve as transparent portions 22. Such minute openings are formed through the resin film by a laser or a mechanical process. In the real process, it is preferred to form each opening to a diameter as large as or slightly less than a target diameter. Alternatively, the masking layer 21 may be made of a transparent resin film with a coloring agent thereon, such as for example Heliogen Blue (Trade Mark) manufactured by BASF, at portions where shaded portions 23 are needed. The masking layer 21 is laid on the transparent substrate 1, thus completing a PPU 10*a*. Due consideration of balance with techniques used in the other fabrication steps determines in what stage the masking layer 21 should be laid on the transparent substrate 1.

Excluding the fabrication step of laying the masking layer 21, the other fabrication steps in manufacturing the PPUs 10*a* may be the same as their counterparts disclosed in U.S. Pat No. 5,815,774. The transparent substrate 1 may be made of such a material as glass or resin (for example, polyethylene telephtalate). Vapor deposition or dip coating or spray coating may be used in forming transparent conductive layer 2. Dip coating technique, which is used to form an ordinary organic photosensitive drum, may be used to form the photoconductive layer 3.

According to the first preferred implementation of the present invention, the PPU 10*a* has the masking layer 21 that prevents irradiation of light to portions of the photoconductive layer 3 right below the insulating protrusions 12. Accordingly, occurrence of electric charges within portions right below the insulating portions 12 is prevented, thus suppressing a deterioration in resolution caused thereby.

Second Preferred Implementation

Figure 4:
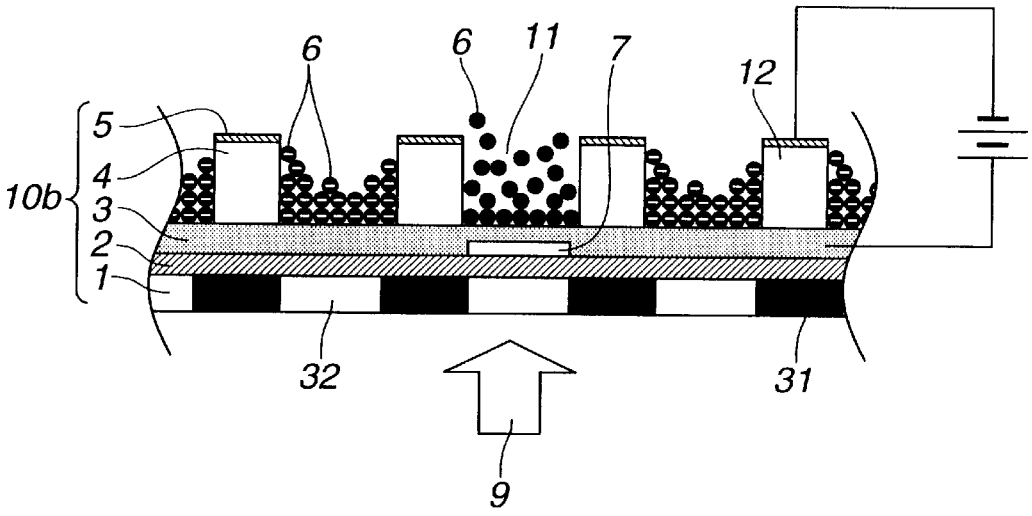
FIG. 4 is a schematic view illustrating an internal structure of and a flight of conductive color particles within a PPU, illustrating a second preferred implementation according to the present invention.

FIG. 4 illustrates a portion of the second preferred implementation according to the present invention.

This second preferred implementation is substantially the same as the first preferred implementation except the fact that a transparent substrate 1 has an integral portion so modified as to perform the function of the physically separate masking layer 21. Accordingly, the same or similar reference numerals are used in FIGS. 2 and 4 to designate the same or similar parts or portions.

In FIG. 4, a PPU 10*b* according to the second preferred implementation has a transparent substrate 1 that includes integral absorption portions 31. The absorption portions 31 can absorb light 9 emitted by a light source. The absorption portions 31 are located right below insulating protrusion 12 of the PPU 10*b*, respectively. The transparent substrate 1 has transparent portions 32, which are located below holes 11 of the PPU 10*b*, respectively. The transparent portions 32 have sufficiently high transmittance. The absorption portions 31 and transparent portions 32 are dimensioned and arranged in the same manner as the shading portions 23 are. Preferably, the contour of each of exposed regions 7, which is projected onto the photoconductive layer 3, is in exact agreement with or located inwardly of the contour of the corresponding hole 11. To accomplish this relationship, it is preferred to arrange each of the transparent portions 22 of the masking layer 21 such that its contour falls slightly inwardly of the contour of the corresponding hole 11 (see FIG. 3).

In order to form the absorption regions 31, the transparent substrate 1 is implanted with metal ions and colored at portions where the absorbent regions 31 to be formed. Wavelength and intensity of light from the light source determine kind and quantity of metal ion is to be implanted. The step of coloring by ion implantation should be carried out before forming other layer on the transparent substrate 1.

According to the second preferred implementation of the present invention, the PPU 10*b* has the absorption regions 31 that prevent irradiation of light to portions of the photoconductive layer 3 right below the insulating protrusions 12. Accordingly, even if portions that are exposed are wider than the holes 11, occurrence of electric charges within portions right below the insulating portions 12 is prevented, thus suppressing a deterioration in resolution caused thereby.

Third Preferred Implementation

Figure 5:
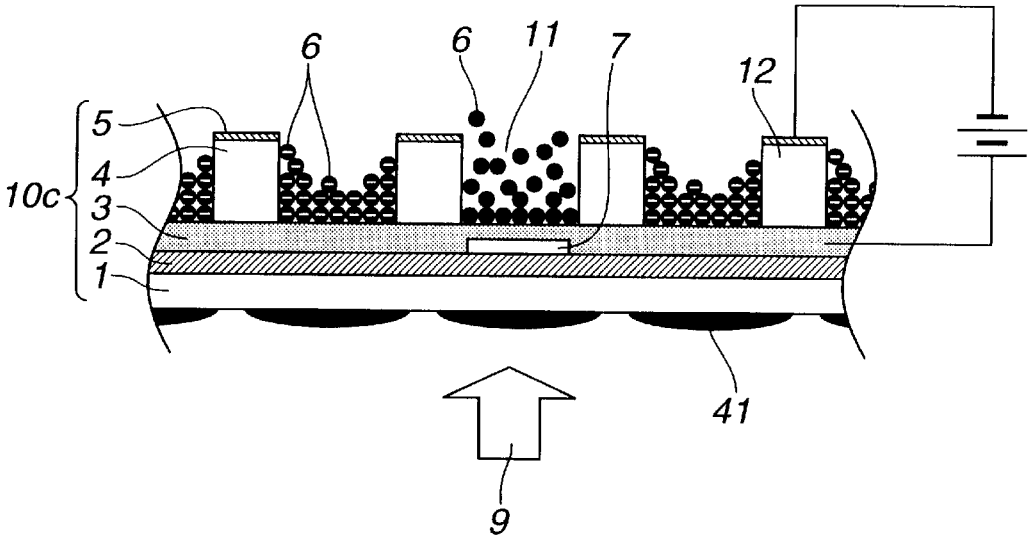
FIG. 5 is a schematic view illustrating an internal structure of and a flight of conductive color particles within a PPU, illustrating a third preferred implementation according to the present invention.
Figure 6A:
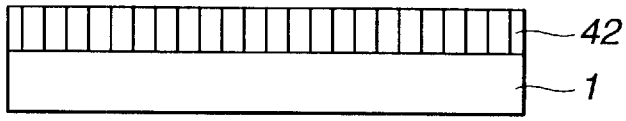
FIGS. 6(*a*) through 6(*e*) are schematic views illustrating a portion of fabrication processes for the PPU shown in FIG. 5.
Figure 6B:
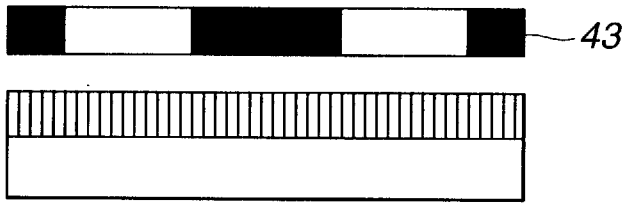
Figure 6C:
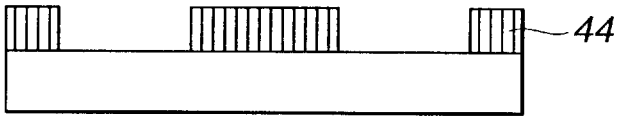
Figure 6D:
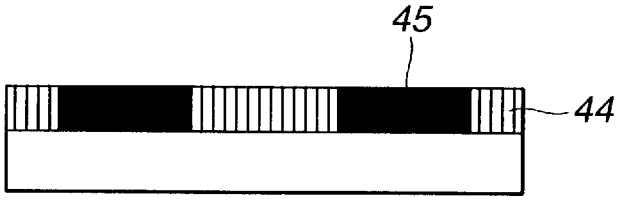
Figure 6E:
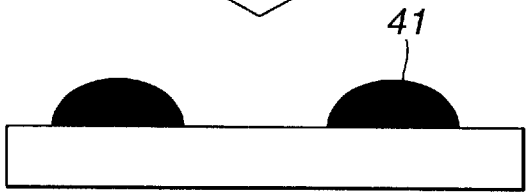

FIG. 5 illustrates a portion of the third preferred implementation of a PPU 10*c* according to the present invention and FIGS. 6(*a*) to 6(*e*) illustrate a portion of fabrication steps of manufacturing a transparent substrate 1 used in FIG. 5.

The third preferred implementation is substantially the same as the first or second preferred implementation except the manner of preventing irradiation of incident light onto the portions of a photoconductive layer right below insulating protrusions 12. In the first or second preferred implementation, the light rays directed toward the portions of the photoconductive layer 3 right below the insulating protrusion 12 have been shaded or absorbed. In the third preferred implementation, convex lenses 41 are provided to focus the light rays on the portions of a photoconductive layer 3 immediately below holes 11 of a porous insulating layer 4.

In FIG. 5, the convex lenses 41 are attached to the inner periphery (lower side viewing in FIG. 5) of the transparent substrate 1 at portions right below the holes 11, respectively. The diameter of each of the lenses 41 is greater than the diameter of the corresponding one of the holes 11 such that each lens 41 does not extend portions right below the adjacent holes 11. A portion of the light ray oriented toward one of the holes 11 passes through the corresponding one of the lens 41 to irradiate the portion of right below the one hole 11. The other portion of the light ray oriented toward the adjacent insulating protrusion 12 to the one hole 11 changes its direction as it passes through the lens 41 to irradiate the portion right below the one hole 11. In this manner, each of the lenses 41 focuses the entire incident light ray on the portion right below the corresponding one hole 11. The setting, in diameter, thickness and material, of each of the lenses 41 is such that the contour of the corresponding one of exposed region 7 matches or falls slightly inwardly of the contour of the corresponding hole 11. Accordingly, there occurs no irradiation of light to the portions of the photoconductive layer 3 right below the insulating protrusions 12.

Referring to FIGS. 6(*a*) to 6(*e*), a description is made on the fabrication steps in forming the convex lenses 41.

In FIG. 6(*a*), a dry film 42 is laid on the surface of transparent substrate 1 and heated to produce a laminated structure. Subsequently, the dry film 42 is patterned to produce the same porous pattern as the pattern in which the holes 11 are arranged in the porous insulating layer 4. Concretely, with a mask 43 placed on the laminated structure as shown in FIG. 6(*b*), the dry film 42 is exposed and subsequently subjected to a predetermined treatment to remove portions where the holes 11 are to be located, respectively, as shown in FIG. 6(*c*). In FIG. 6(*c*), only portions 44 of the dry film 42, which are to locate right below the insulating protrusion 12, remain on the transparent substrate 1. These portions 44 are referred, hereinafter, as frame portions.

As shown in FIG. 6(*d*), recesses defined by the frame portions 44 are filled with glass paste 45. Baking is carried out to melt the glass paste 45 and burn the frame portions 44. In process of baking, the glass paste 45 in each of the recesses protrudes to form a spherical surface due to surface tension as shown in FIG. 6(*e*). The temperature during the baking step is lower than a melting point of the material of the transparent substrate 1, but higher than a melting point of the glass paste 45. In this manner, the convex lenses 41 are produced.

Because the baking is included in the fabrication steps, resin may not be used as material of the transparent substrate 1. Besides, prior to forming a transparent conductive layer 2, the convex lenses 41 must be formed on the transparent substrate 1.

According to the third preferred implementation of the present invention, the PPU 10*c* has the lenses 41 that focuses light ray oriented toward the insulating protrusion 12 onto the portions right below the holes 11. Accordingly, even if portions that are exposed are wider than the holes 11, occurrence of electric charges within portions right below the insulating portions 12 is prevented, thus suppressing a deterioration in resolution caused thereby.

Because the light rays directed toward the insulating protrusion 12 are focused on the portions right below the holes 11, the light is saved. It is possible to decrease the output of the light energy. Accordingly, there is a drop in the power consumption of the image forming apparatus using the PPU 10*c*. Because light is prevented from irradiating unnecessary portions, temperature increase of the PPU is effectively suppressed. Thus, a deviation due to thermal expansion can be prevented.

Fourth Preferred Implementation

Figure 7:
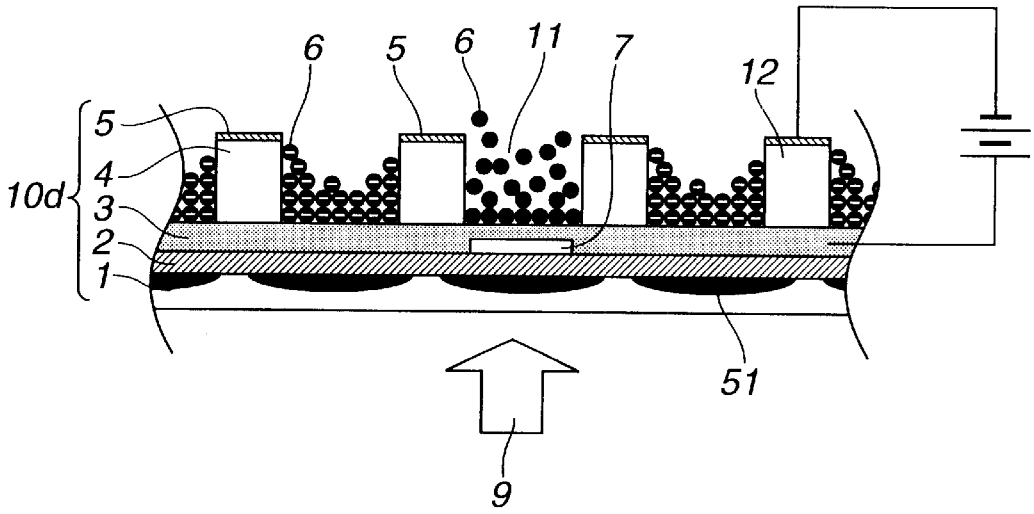
FIG. 7 is a schematic view illustrating an internal structure of and a flight of conductive color particles within a PPU, illustrating a fourth preferred implementation according to the present invention.
Figure 8A:
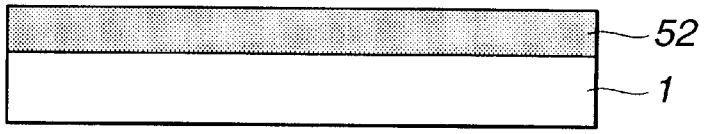
FIGS. 8(*a*) through 8(*d*) are schematic views illustrating a portion of fabrication processes for the PPU shown in FIG. 7.
Figure 8A:
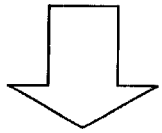
Figure 8B:
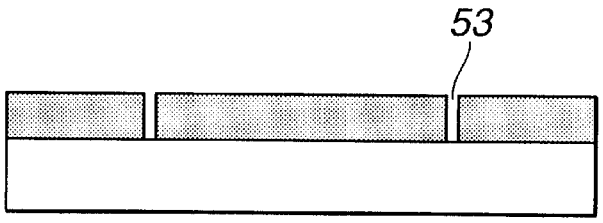
Figure 8B:
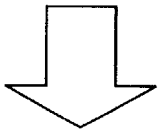
Figure 8C:
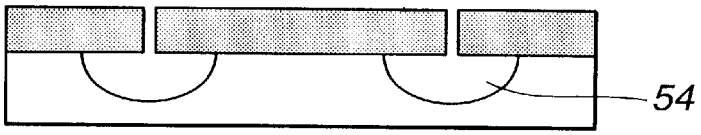
Figure 8C:
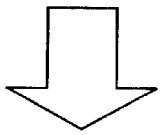
Figure 8D:
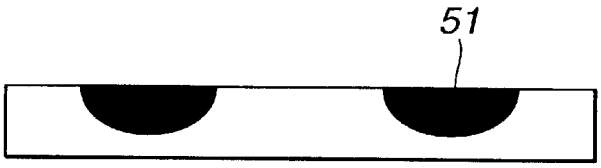
Figure 9A:
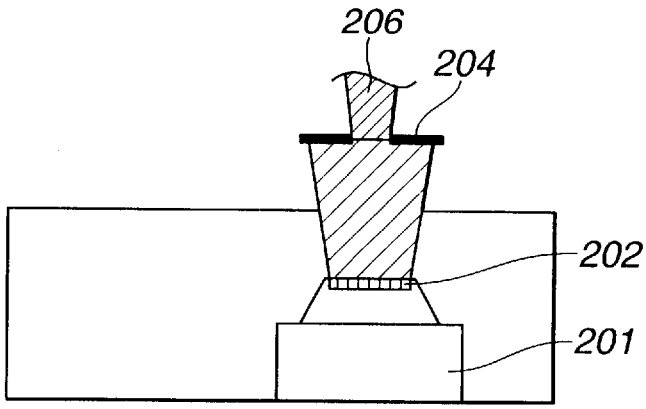
FIGS. 9(*a*) through 9(*d*) are schematic views of different examples of a light source, illustrating a fifth preferred implementation according to the present invention.
Figure 9B:
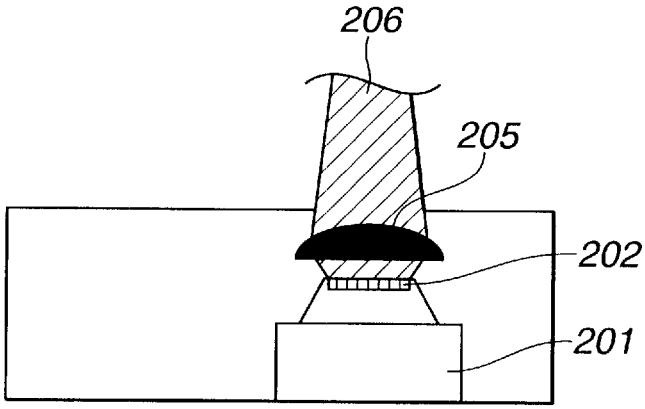
Figure 9C:
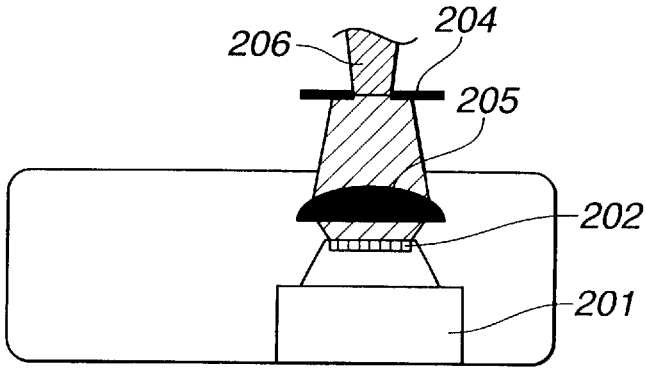
Figure 9D:
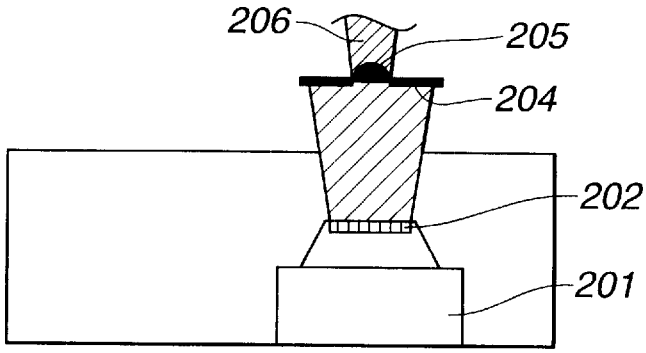

FIG. 7 illustrates a portion of the fourth preferred implementation of a PPU 10*c* according to the present invention and FIGS. 8(*a*) to 8(*d*) illustrate a portion of fabrication steps of manufacturing a transparent substrate 1 used in FIG. 7.

The fourth preferred implementation is substantially the same as the third preferred implementation except the manner of mounting the lenses to the transparent substrate 1. In the third preferred implementation, the convex lenses 41 are attached to the light source side of the transparent substrate 1, while, in the fourth preferred implementation, convex lenses 51 are embedded inwardly into a substrate 1 from a surface, which a transparent conductive layer 2 is formed on.

In FIG. 7, the convex lenses 51 are embedded inwardly of the transparent substrate 1 from the side near the transparent conductive layer 2 at portions right below holes 11, respectively. The diameter of each of the lenses 51 is greater than the diameter of the corresponding one of the holes 11 such that each lens 51 does not extend portions right below the adjacent holes 11. The index of refraction of a material forming the convex lenses 51 is higher than that of a material forming the transparent substrate 1.

A portion of the light ray oriented toward one of the holes 11 passes through the corresponding one of the lens 51 to irradiate the portion of right below the one hole 11. The other portion of the light ray oriented toward the adjacent insulating protrusion 12 to the one hole 11 changes its direction as it passes through the lens 51 to irradiate the portion right below the one hole 11. In this manner, each of the lenses 51 focuses the entire incident light ray on the portion right below the corresponding one hole 11. The setting, in diameter, thickness and material, of each of the lenses 51 is such that the contour of the corresponding one of exposed region 7 matches or falls slightly inwardly of the contour of the corresponding hole 11. Accordingly, there occurs no irradiation of light to the portions of the photoconductive layer 3 right below the insulating protrusions 12.

Referring to FIGS. 8(*a*) to 8(*d*), a description is made on the fabrication steps in forming the convex lenses 51.

In FIG. 8(*a*), a photo resist layer 52 is formed on the surface of transparent substrate 1 and heated to produce a laminated structure. Subsequently, as shown in FIG. 8(*b*), the photo resist layer 52 is patterned to produce openings 53 at locations, which are to become center positions of convex lenses to be formed later. The photo resist layer 52 formed with the openings 53 is used as a mask for etching. The mask for etching is not limited to the above-mentioned photo resist layer 52. A metal mask may be used in etching.

Referring to FIG. 8(*c*), the transparent substrate 1 is etched by a solvent via the openings 53. As a result, part-spherical recesses 54 are formed around the locations of the openings 53, respectively. Naturally, the chemical composition of the material of the transparent substrate 1 determines the solvent to be used in etching.

Referring next to FIG. 8(*d*), a material that has an index of refraction higher than an index of refraction of the material of transparent substrate 1 is embedded into the recesses 54, thus producing the desired convex lenses 51 in the presence of heat during baking. Preferably, the material to be embedded into the recesses 54 is selected from a group including, for example, glass paste, thermosetting resin or photo setting resin, which resin includes fine particles of metal oxides, such as for example $TiO_2$ and ZnO, in dispersed state for adjustment of refractory index, and non-organic thin film material, such as for example $SiO_2$. In the above-mentioned manner, the convex lenses 51 can be embedded into the transparent substrate 1.

Because the baking is included in the fabrication steps, resin may not be used as material of the transparent substrate 1. Besides, prior to forming a transparent conductive layer 2, the convex lenses 51 must be formed on the transparent substrate 1.

Because, in the PPU 10*d* according to the fourth preferred implementation, the light rays directed toward the insulating protrusion 12 are focused on the portions right below the holes 11, the light rays are not irradiated on the portions right below the insulating protrusions 12. A deterioration in resolution is prevented because electric charges right below the insulating protrusion 12 do not occur.

Besides, the light source side of the transparent substrate 1 of the PPU 10*d* is smooth, making it easier to clean the surface.

Fifth Preferred Implementation

Referring to FIGS. 9(*a*) to 9(*d*), a description is made on the fifth preferred implementation of a light source according to the present invention.

The light source in the illustrated state is mounted to an image forming apparatus equipped with a PPU. The light source illustrated is provided with a mechanism to control beam so as to irradiate light to a desired region only with good accuracy.

As shown in FIGS. 9(*a*) to 9(*d*), the light source is provided with an LED array 201 and a beam control element.

The LED array 201 includes a plurality of light-emitting elements, each being in the form of, for example, an LED, which are subject to individual luminous controls, respectively. The light emitting elements are arranged to match the color particle filling holes, respectively. When the light source is installed in an image forming apparatus, each of the LED light emitting elements is arranged to irradiate light to the corresponding one of the holes of the PPU. With a light source of the conventional type wherein a single light-emitting element is used for scanning, the irradiation of light to a region between the adjacent two holes tends to occur. In contrast, the arrangement according to this preferred implementation wherein each of the light-emitting elements irradiates light to the associated one of holes is advantageous to the above-mentioned conventional type for enhanced resolution.

A beam control element is provided to restrict in cross sectional area and profile of a beam emitted by a luminous portion 202 of each of light emitting elements, thereby to restrict a beam of light source light 206. According to the fifth preferred implementation, the beam control element uses at least one of a light-shading mask 204 and a micro lens 205. FIG. 9(*a*) illustrates the use of a light-shading mask 204. FIG. 9(*b*) illustrates the use of a micro lens 205. FIG. 9(*c*) illustrates the use of a light shading mask 204 and a micro lens 205. FIG. 9(*d*) illustrates the use of a light-shading mask 204 and a micro lens 205. In FIG. 9(*c*), the micro lens 205 is disposed between the light-shading mask 204 and the luminous portion 202. In FIG. 9(*d*), the micro lens 205 covers a light path opening of the light-shading mask 204. If both of light shading mask 204 and micro lens 205 are used, any desired one of them may be disposed between the luminous portion 202 and the other.

Referring to FIGS. 9(*a*) to 9(*d*), a beam of light emitted by a luminous portion 202 of each of LED light-emitting elements passes through its associated light-shading mask 204 and/or its associated micro lens 205 where the diameter of the beam is restricted sufficiently to produce a light source light 206. When the light source in this form is installed in an image forming apparatus, the light source light 206 is irradiated to the portion right below the desired hole, only. Irradiation of light to the portion below an insulating protrusion 12 (see FIG. 7) and irradiation to the portions below the adjacent holes other than the desired hole will not take place.

In the image forming apparatus using the light source of the above kind, the cross sectional area and profile of a transparent portion of the light-shading mask 204 and/or the diameter and the curvature of the micro lens 205 are determined such that the diameter of the contour of each of exposed regions of a photoconductive layer 3 matches or falls slightly inwardly of the contour of the corresponding hole.

According to the light source of the fifth preferred implementation, the diameter of the beam of light is very small, thus making possible high-resolution exposure possible on a photosensitive medium.

Sixth Preferred Implementation

Referring to FIGS. 10(*a*) to 10(*d*) and 11(*a*) to 11(*d*), a description is made on the sixth preferred implementation of a light source according to the present invention.

The sixth preferred implementation is substantially the same as the fifth preferred implementation except the provision of an optical fiber lens array 203 in addition to a LED array 201, a light-shading mask 204 and a micro lens 205.

As is readily seen from FIGS. 10(*a*) to 10(*d*) and 11(*a*) to 11(*d*), optical fiber lenses of an optical fiber lens array 203 are associated with LED light emitting elements of an LED array 201, respectively. The associated optical fiber lenses gather light rays emitted by the LED light emitting elements.

The above-mentioned light-shading mask 204 and micro lens 205 may be disposed between the optical fiber lens array 203 and the LED array 201 or the optical fiber lens array 203 may be disposed between the LED array 201 and both of the light-shading mask 204 and micro lens 205.

FIG. 10(*a*) illustrates the case where an optical fiber lens array 203 is disposed between an LED array 201 and a light-shading mask 204. FIG. 10(*b*) illustrates the case where a light-shading mask 204 is disposed between an LED array 201 and an optical fiber lens array 203. FIG. 10(*c*) illustrates the case where a micro lens 205 is disposed between an LED array 201 and an optical fiber lens array 203. FIG. 10(*d*) illustrates the case where an optical fiber lens array 203 is disposed between an LED array 201 and a micro lens 203. FIG. 11(*a*) illustrates the case where a light-shading mask 204 is disposed between an LED array 201 and a micro lens 205 and an optical fiber lens array 203 is disposed between the light-shading mask 204 and the LED array 201. FIG. 11(*b*) illustrates the case where an optical fiber lens array 203 is disposed between a light-shading mask 204 and an LED array 201 and a micro lens 205 is disposed between the optical fiber lens array 203 and the LED array 201. FIG. 11(*c*) illustrates the case where an optical fiber lens array 203 is disposed between a micro lens 205 and a LED array 201 and a light-shading mask 204 is disposed between the optical fiber lens array 203 and the LED array 201. FIG. 11(*d*) illustrates the case where a micro lens 205 is disposed between an optical fiber lens array 203 and an LED array 201 and a light-shading mask 204 is disposed between the micro lens 205 and the LED array 201.

In the image forming apparatus using the light source of the above kind, the cross sectional area and profile of a transparent portion of the light-shading mask 204 and/or the diameter and the curvature of the micro lens 205 and the optical fiber lens are determined such that the diameter of the contour of each of exposed regions of a photoconductive layer 3 matches or falls slightly inwardly of the contour of the corresponding hole.

A beam of light emitted by a luminous portion 202 of each of LED light-emitting elements passes through its associated light-shading mask 204 and/or its associated micro lens 205 and the associated optical fiber lens of the optical fiber lens array 203 where the diameter of the beam is restricted sufficiently to produce a light source light 206. When the light source in this form is installed in an image forming apparatus, the light source light 206 is irradiated to the portion right below the desired hole, only. Irradiation of light to the portion below an insulating protrusion 12 (see FIG. 7) and irradiation to the portions below the adjacent holes other than the desired hole will not take place.

From the preceding description, it is to be noted that the fifth and sixth preferred implementations produce substantially the same effect.

Seventh Preferred Implementation

Figure 12:
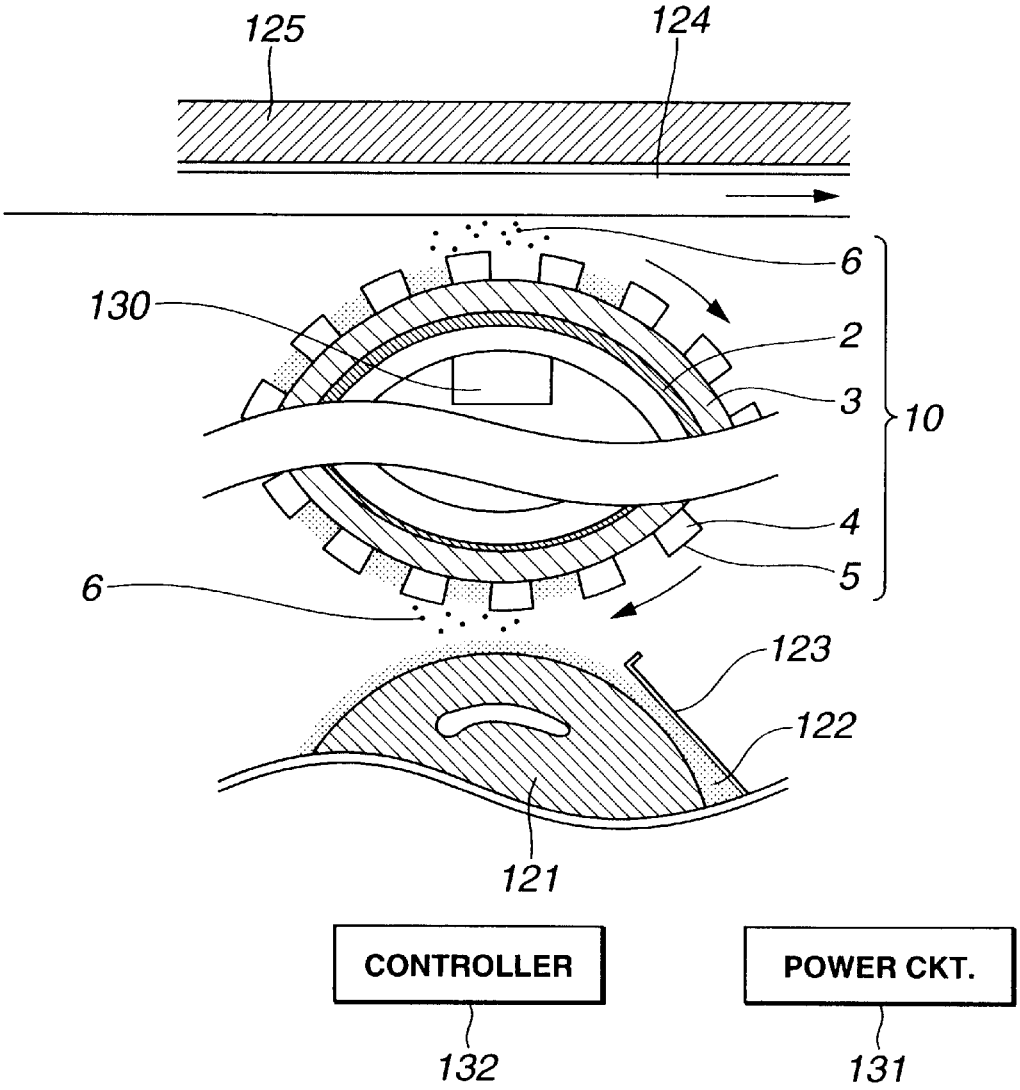
FIG. 12 is a schematic view of a portion of an image forming apparatus, illustrating a seventh preferred implementation according to the present invention.

Referring to FIG. 12, a description is made of the seventh preferred implementation of an image forming apparatus according to the present invention. The image forming apparatus comprises a PPU selected from the various kinds of PPUs 10*a*, 10*b*, 10*c*, and 10*d*, a light source 130 that may be selected from various kinds of light sources illustrated in FIGS. 9(*a*) to 11(*d*), a various kinds of power circuits 131 to apply predetermined voltages to various portions of the apparatus, a controller 132 to control the various portion of the apparatus, a paper feeder, and drivers to drive the various portions of the apparatus.

The PPU 10 is arranged for rotation in a predetermined direction in the presence of a driver, not shown. Within its interior space, the PPU 10 has a light source 130. As viewed in FIG. 12, a conductive particle supply roller or conductive roller 121 is arranged below the PPU 10 in a spaced relationship. The conductive roller 121 is arranged to supply conductive color particles 6 to the PPU 10. With respect to the direction of rotation of the PPU 10, a counter electrode 125 is arranged in a spaced relationship from the PPU 10 at a portion downstream of the conductive roller 121. In process of forming an image, a recording medium 124 passes through the space between the counter electrode 125 and the PPU 10.

The color conductive particles 6 are brought into adherence to the outer periphery of the conductive roller 121 by means of a suitable mechanism, not illustrated. A regulating blade 123 removes an excessive amount of the adhered color conductive particles 6 as the conductive roller 121 rotates, thereby to adjust the thickness of a layer of the particles 6. Accordingly, the adhesive conductive particles 6 form a conductive particle thin layer 122 with a uniform thickness within a region opposed to the PPU 10.

Predetermined voltages are applied to a transparent conductive layer 2, an upper electrode 5 and the conductive roller 121, respectively. Thus, within an area where the PPU 10 and the conductive roller 121 are opposed to each other, there is induced electric field oriented from the transparent conductive layer 2 toward the conductive roller 121.

Induction charging in the presence of this electric field causes negative charging of the conductive particles of the thin layer 122. Electric force is applied to the negatively charged conductive color particles 6 of the thin layer 122, causing them to fly toward the PPU 10. The conductive color particles 6 that strike the upper electrode 5 are positively charged in the presence of the electric field, and return toward the conductive roller 121. Thus, only the holes of the porous insulating layer 4 are filled with the negatively charged conductive color particles 6. The negatively charged color particles enter the adjacent holes in such a manner as to bring potential of the conductive color particles 6 in each of the holes to a level as high as the potential of the upper electrode 5, so that electric field at the surface of the particles approaches toward zero (0). According to this mechanism, the color particles that have entered the holes of the porous insulating layer 4 are trapped therein.

Rotation of the PPU 10 causes the surface region of the PPU 10 that has holes filled with the conductive color particles 6 to enter an image recording area where this surface region is opposed to the counter electrode 125 and also to the recording medium 124.

The light source 130 irradiates light to a photoconductive layer 3 within the image recording area portion. Naturally, the region to which the light source irradiates light is determined in accordance with an image data. In the image forming apparatus of this seventh preferred implementation, the PPU 10 is selected from the first to fourth preferred implementations and the light source 130 is selected from the fifth and sixth preferred implementations. Thus, the irradiation of light to portions other than the portions right below the desired holes will not take place.

At regions where light is irradiated, the permittivity of the photoconductive layer 3 becomes high. The electric charges of the conductive color particles 6 leak through the regions of the photoconductive layer 3 whose permittivity has become high. This leak of the electric charges causes the level of potential of the conductive color particles 6 within the holes to approach the level of potential of the transparent conductive layer 2, thereby producing electric field on the surface of a layer of conductive color particles 6. The conductive color particles 6 near the upper electrode 5 are positively charged. As mentioned before, the predetermined voltage is applied to the counter electrode 125. Thus, within the image recording area, there is electric field oriented from the transparent conductive layer 2 toward the counter electrode 125. Accordingly, the positively charged conductive color particles 6 fly out of the holes toward the counter electrode 125. These particles adhere to the recording medium 124, thus producing the image thereon.

According to the sixth preferred implementation of image forming apparatus, the target region only is exposed with excellent accuracy. As a result, high-resolution image can be produced.

Embodiments

In order to confirm the effect of the present invention, the Applicants have made an experiment as follows.

1. Performance Test (Apparatus and Material)

A description is made of an image forming apparatus, conductive color particles, and a PPU (porous photosensitive unit), which have been used in conducting performance tests.

1.1 Image Forming Apparatus

The image forming apparatus described as the seventh preferred implementation in connection with FIG. 12 was used. However, the image forming apparatus used conductive color particles and a PPU 10 as follows.

1.2 Conductive Color Particles

Conductive color particles were prepared in the following manner. The term "color" is used throughout the specification to mean not only chromatic color, but also achromatic color.

Materials, such as, a binding resin, a coloring agent, a charge controlling agent, and a wax, were mixed. After mixing the materials, using a kneading apparatus "S1KRC KNEADER" manufactured by Kurihara Ironworks Co. Ltd., the materials were subject to kneading, cooling and pulverization. Styrene acryl polymer "HIMER TB 9000" (Trade Name), manufactured by Sanyo Chemical Industries, Ltd., of 100 parts by weight was used as the binding resin. Carbonblack "MA-100" (Trade Name), manufactured by Mitsubishi Chemical Corp., of 9 parts by weight was used as the coloring agent. Spironblack "TRH-C" (Trade Mark), manufactured by Hodogaya Chemical Industry, Ltd., of 2 parts by weight was used as the charge controlling agent. Bisscall 550 P (Trade Name), manufactured by Sanyo Chemical Industries, Ltd., of 4 parts by weight was used as the wax.

Using a high precision powder classifier manufactured by Nippon Pneumatic Industry Co., Ltd. the pulverized materials are classified to obtain insulating color particles having a particle diameter ranging from 5 to 15 $\mu$m (the average particle diameter of 10 $\mu$m).

ITO fine particles are embedded into the surface of each insulating color particle to form a photoconductive layer, thereby to provide conductive color particles. 4 g of ITO fine particles having a primary particle diameter of about 150 nm were added per each 16 g of the insulating color particles and mixed therewith and then the mixture was processed by a HYBRIDYEZATION system of the NHS-0 type manufactured by Nara Machinery Co., Ltd. at a speed of 13,000 rpm for 2 minutes.

1.3 PPU (Porous Photosensitive Unit)

Different PPUs according to the first to fourth preferred implementations, respectively, were prepared. For comparison, a conventional PPU was prepared. The PPUs prepared for the experiment are as follows:

In the PPU 10*a* according to the first preferred implementation, a coloring agent "Heliogen Blue" (Trade Name) manufactured by BASF was painted to a transparent resin film at portions, forming light shading portions 23 of a masking layer 21. Portions left unpainted form transparent portions 22 of the masking layer 21. The transparent portions 22 having a diameter of 100 $\mu$m were left at a regular pitch of 130 $\mu$m.

In the PPU 10*b* according to the second preferred implementation, a transparent substrate 1 has an integral portion so modified as to perform the function of the masking layer 21. This integral portion has a number of absorption portions 31 and transparent portions 32. The transparent portions 32 having a diameter of 100 $\mu$m were left at a regular pitch of 130 $\mu$m.

In the PPU 10*c* according to the third preferred implementation, a transparent substrate 1 with lenses 41 was prepared in accordance with the fabrication steps illustrated in FIGS. 6(*a*) to 6(*e*).

As the transparent substrate 1, a glass substrate was used. As a dry film 42, a dry film of the negative type "Ordeal" (Trade Name) manufactured by Tokyo Applied Chemical Industry Co., Ltd. was used. A glass paste manufactured by NEC Glass Co., Ltd. was used. A thermo-compression roller is used to laminate the dry film 42 onto the glass substrate at temperature of 105° C. A contact exposure technique was used to of a line segment having a width of 30 $\mu$m. In this case, a pitch in vertical as well as horizontal direction was 130 $\mu$m.

In the PPU 10*d* according to the fourth preferred implementation, a transparent substrate 1 with embedded lenses 51 was prepared in accordance with the fabrication steps illustrated in FIGS. 8(*a*) to 8(*d*).

As the transparent substrate 1, a soda glass substrate was used. A photo resist manufactured by Tokyo Applied Chemical Industry Co., Ltd. was used to form over the soda glass substrate a thin film having a thickness of 5 $\mu$m. This photo resist thin layer is subject to a grid patterning having a pitch of 130 $\mu$m to form a number of circular openings 53 each having a diameter of 50 $\mu$m. Hydrofluoric acid was used to etch through the openings 53 the surface of the soda glass substrate for 20 minutes. As a result, a number of part-spherical recesses, each having a depth of about 10 $\mu$m, were formed. A glass paste having a refractory index higher than that of the soda glass substrate was poured into the part-spherical recesses. A backing was conducted to fix the glass paste within the part-spherical recesses to produce the desired convex lenses 51.

The other portions of the PPUs 10*a*, 10*b*, 10*c* and 10*d*, which were not referred to above, are substantially in common. A description of them will follow:

As the transparent substrate 1, a cylinder of glass or polyethylene telephtalate was used. The cylinder dimensions were 30 mm in diameter, 250 mm in length, and 1 mm in wall thickness.

The dip coating technique was used to apply ITO to the outer cylindrical surface of the transparent substrate 1, thus forming a transparent conductive layer 2 having a thickness of 30 nm.

A photoconductive layer 3 is composed of a charge generating layer portion and a charge transporting layer portion. The photoconductive layer 3 was prepared in the following manner. The dip coating technique was used to apply tetrahydrofuran dispersion solution of titanphthalocyanine and polyvinyl butyral to an outer surface of the transparent conductive layer 2, thereby to form the charge generating layer portion having a thickness of 0.5 $\mu$m. Next, the dip coating technique was used to apply tetrahydrofuran dispersion solution of amine compound and polycarbonate to an outer surface of the charge generating layer portion, thereby to form the charge transporting layer portion having a thickness of 10 μm.

A porous insulating layer 4 was prepared in the following manner. The dip coating technique was used to apply photosetting resin (epoxy resin) to an outer surface of the photoconductive layer 3, thereby to form an insulating layer having a thickness of 100 μm. With a mask on it, this insulating layer was exposed to radiation of ultraviolet light, thereby to form holes having a diameter of 100 μm at a regular pitch of 130 μm.

The vacuum deposition technique was used to deposit aluminium on an outer surface of the porous insulating layer, thereby to form an upper electrode 5 having a thickness of 30 nm.

2. Performance Test (Conditions and Procedure)

Fourteen different combinations of five distinct PPUs and three distinct light sources were tested in comparison with a comparative example that is a combination of a conventional PPU and a conventional light source. It is to be noted that the five distinct PPUs include the conventional PPU and the three distinct light sources include the conventional light source. An image of one dot line and an image of one dot (minimum dot) were formed. The images resulting from the test of each of the various combinations were perceived by human eyes. The above-mentioned fourteen different combinations and one conventional combination can be listed in the following Table.

Figure 10A:
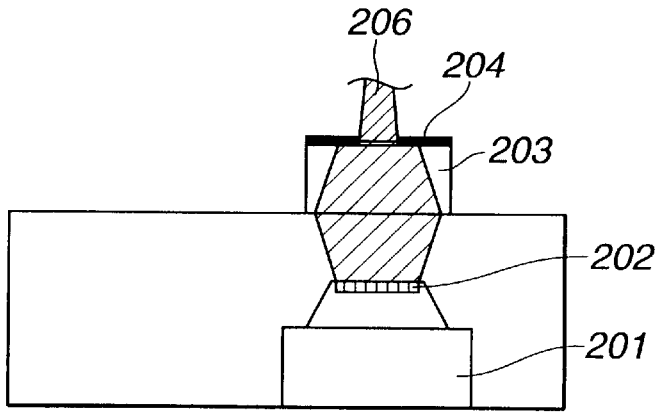
FIGS. 10(*a*) through 10(*d*) are schematic views of different examples of a light source, illustrating a sixth preferred implementation according to the present invention.
Figure 10B:
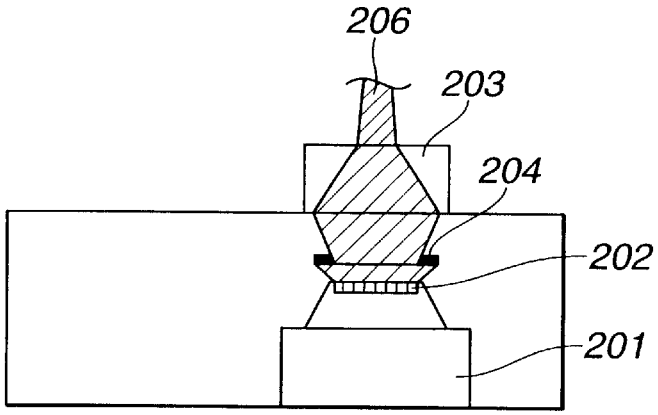
Figure 10C:
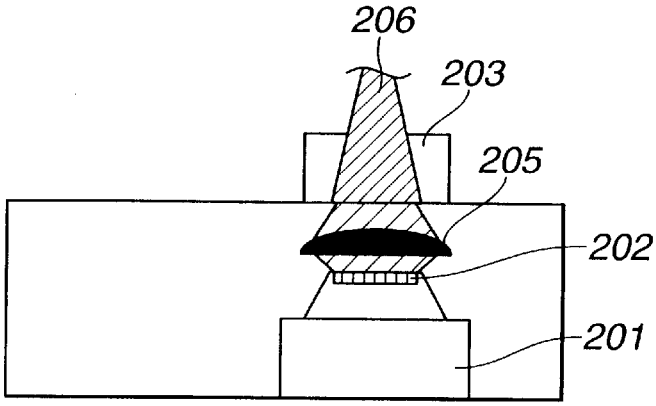
Figure 10D:
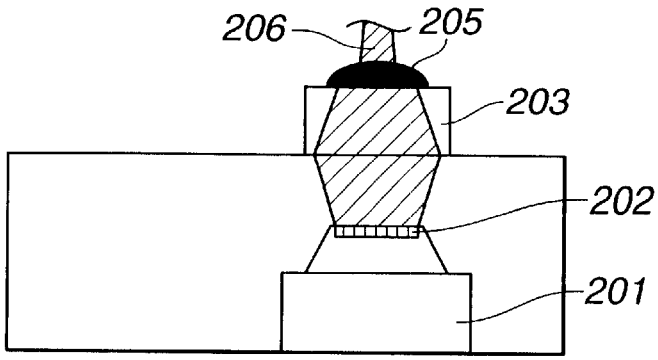
Figure 11A:
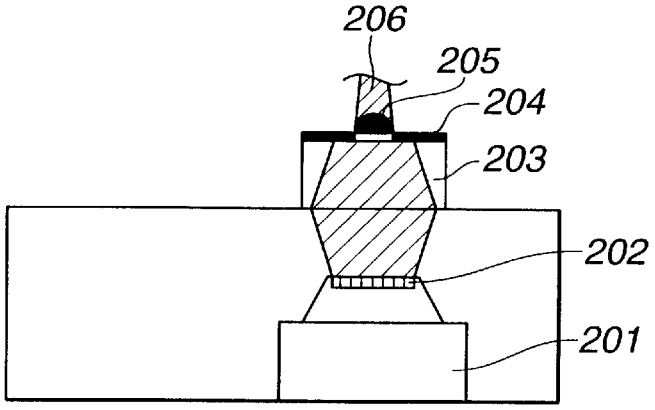
FIGS. 11(*a*) through 11(*d*) are schematic views of other different examples of a light source belonging to the sixth preferred implementation.
Figure 11B:
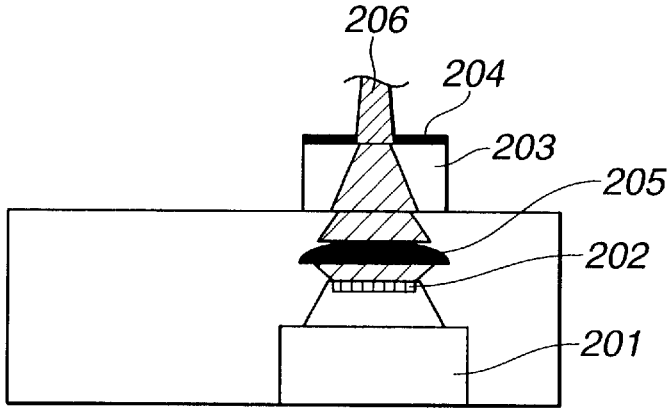
Figure 11C:
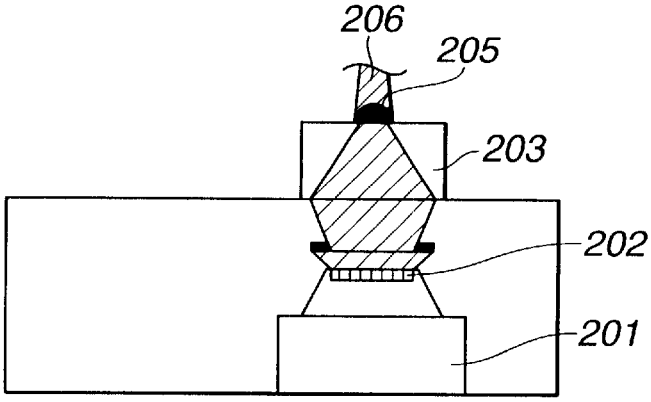
Figure 11D:
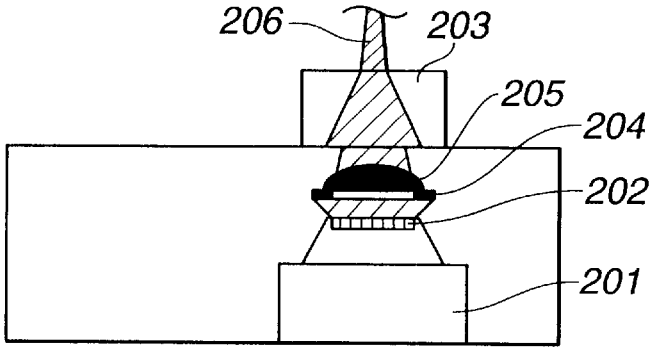

| | PPU | Light Source |
|---|---|---|
| Emb. 1 | FIG. 2 | Conventional |
| Emb. 2 | FIG. 4 | Conventional |
| Emb. 3 | FIG. 5 | Conventional |
| Emb. 4 | FIG. 7 | Conventional |
| Emb. 5 | FIG. 2 | FIG. 10(a) |
| Emb. 6 | FIG. 4 | FIG. 10(a) |
| Emb. 7 | FIG. 5 | FIG. 10(a) |
| Emb. 8 | FIG. 7 | FIG. 10(a) |
| Emb. 9 | FIG. 2 | FIG. 11(a) |
| Emb. 10 | FIG. 4 | FIG. 11(a) |
| Emb. 11 | FIG. 5 | FIG. 11(a) |
| Emb. 12 | FIG. 7 | FIG. 11(a) |
| Emb. 13 | Conventional | FIG. 10(a) |
| Emb. 14 | Conventional | FIG. 11(a) |
| Com. Ex. | Conventional | Conventional |

3. Results

The comparative example produced images with low resolution. In contrast, embodiments 1 to 4 produced images with good resolution as compared to the comparative example. Embodiments 5 to 12 produced images with excellent resolution. Embodiments 13 and 14 produced images with enhanced resolution as compared to the comparative example.

While the present invention has been described along with the illustrated examples, it is evident that the PPU 10*a* includes restrainer means 21 whereby an optical arrangement is provided, in which, when a light source emits light 9 to cause conductive color particles 6 to fly out of a desired hole only, the light 9 exposes a region 7, within a photoconductive layer 3, which substantially coextends with a surface portion of the layer 3 that is exposed by the desired hole. In FIG. 2, the restrainer means is a masking layer 21. The masking layer 21 includes a plurality of portions 23 that absorb the light 9 from the light source, and a plurality of light transparent portions 22 corresponding to the plurality of holes 11, which do not absorb the light 9.

In FIG. 4, the restrainer means include a substrate 1. The substrate absorbs, at portions 31, the light 9 from the light source except a plurality of light transparent portions 32 corresponding to a plurality of holes 11, respectively.

In FIG. 5, the restrainer means include light gathering means for gathering light 9 from a light source at a region 7 that coextends with a surface portion of a photoconductive layer 3 that is exposed by the desired hole. Specifically, the restrainer means include a plurality of lenses 41 corresponding to the plurality of holes 11, respectively. Each of the lenses 41 has a diameter larger than a diameter of the corresponding one of the holes 11 for gathering light 9 at the surface portion of the photoconductive layer 3 that is exposed by the corresponding one hole. In FIG. 7, a plurality of lenses 51 of the embedded type form the restrainer means.

FIGS. 9(*a*) to 11(*d*) illustrate various forms of light source. The light source includes a beam control element to restrict in cross sectional area and profile of a beam of light emitted by each of light-emitting elements of an LED array.

While the present invention has been particularly described, in conjunction with various preferred implementations, it is evident that many alternatives, modifications and variations will be apparent to those skilled in the art in light of the foregoing description. It is therefore contemplated that the appended claims will embrace any such alternatives, modifications and variations as falling within the true scope and spirit of the present invention.

For example, the structure of a PPU 10 is not limited to a cylinder. It may be a flat plate or an endless belt.

In the first preferred implementation, a masking layer 21 has been attached to the lower surface of a transparent substrate 1. If desired, a masking layer 21 may be interposed between a transparent substrate 1 and a transparent conductive layer 2.

With regard to the fifth and sixth preferred implementations, a description has been made on a light source in association with an image forming apparatus using a PPU. The illustrated examples of a light source may be used in an image forming apparatus that operates by a Carlson process.

In the examples illustrated in FIGS. 9(*b*), 9(*c*), 9(*d*), 10(*c*) and 10(*d*), a single micro lens has been used for one of holes 11 of a porous insulating layer 4. If desired, a single micro lens may be replaced with a combination of a plurality of lenses if the contour of exposed region within a photoconductive layer 3 matches or falls slightly inwardly of the contour of the corresponding hole of a porous insulating layer 4.

What is claimed is:

1. A porous photosensitive unit, comprising:

a substrate;

a conductive layer formed on a surface of said substrate;

a photoconductive layer formed on a surface of said conductive layer;

a porous insulating layer formed on a surface of said photoconductive layer, said porous insulating layer having a plurality of holes for holding conductive color particles, said plurality of holes including a first hole and the adjacent second and third holes, said plurality of holes exposing a plurality of surface portions of the surface of said photoconductive layer, respectively, so that said first, second and third holes exposing first, second and third surface portions of said plurality of surface portions, respectively;

an electrode formed on a surface of said porous insulating layer except where said plurality of holes are formed; and restrainer means whereby an optical arrangement is provided, in which, when a light source emits light to cause conductive color particles to fly out of said first hole only, said light exposes a region, within said photoconductive layer, which substantially coextends with said first surface portion.

2. The porous photosensitive unit as claimed in claim 1, wherein said substrate and said conductive layer are transparent with respect to the light from said source of light to allow passage of light, and wherein said restrainer means include a masking layer that absorbs the light from the light source except a plurality of light transparent portions corresponding to said plurality of holes, respectively, said plurality of light transparent portions allowing passage of the light from the light source.

3. The porous photosensitive unit as claimed in claim 2, wherein each of said plurality of light transparent portions has a contour falling inwardly of a contour of the corresponding one of said plurality of holes.

4. The porous photosensitive unit as claimed in claim 1, wherein said restrainer means include said substrate, said substrate absorbs the light from the light source except a plurality of light transparent portions corresponding to said plurality of holes, respectively, said plurality of light transparent portions allowing passage of the light from the light source.

5. The porous photosensitive unit as claimed in claim 3, wherein each of said plurality of light transparent portions has a contour falling inwardly of a contour of the corresponding one of said plurality of holes.

6. The porous photosensitive unit as claimed in claim 1, wherein said restrainer means include light gathering means for gathering the light from the light source at said region only.

7. The porous photosensitive unit as claimed in claim 1, wherein said restrainer means include a plurality of lenses corresponding to said plurality of holes, respectively, and each of said plurality of lenses having a diameter larger than a diameter of the corresponding one of said plurality of holes for gathering light at the surface portion that is exposed by the corresponding one hole.

8. The porous photosensitive unit as claimed in claim 7, wherein said plurality of lenses are fixedly connected to a surface of said substrate.

9. The porous photosensitive unit as claimed in claim 7, wherein said plurality of lenses are embedded into said substrate.

10. An image forming apparatus comprising:

a porous photosensitive unit, said porous photosensitive unit including a substrate, a conductive layer formed on a surface of said substrate;

a photoconductive layer formed on a surface of said conductive layer;

a porous insulating layer formed on a surface of said photoconductive layer, said porous insulating layer having a plurality of holes for holding conductive color particles, said plurality of holes exposing a plurality of surface portions of the surface of said photoconductive layer, respectively;

an electrode formed on a surface of said porous insulating layer except where said plurality of holes are formed; and restrainer means whereby an optical arrangement is provided, in which, when a light source corresponding to a desired one of said plurality of holes emits light to cause conductive color particles to fly out of said desired hole only, said light exposes a region, within said photoconductive layer, which substantially coextends with the surface portion that is exposed by said desired hole;

a plurality of light sources corresponding to said plurality of holes, respectively;

means for supplying conductive color particles to said porous photosensitive unit and holding the conductive color particles in said plurality of holes; and a recording medium;

said plurality of light sources being adapted to emit light to cause at least one of said plurality of holes to allow the conductive color particles to fly out of the hole toward said recording medium.

11. The image forming apparatus as claimed in claim 10, wherein each of said plurality of light sources includes an light-emitting array.

12. The image forming apparatus as claimed in claim 10, wherein each of said plurality of light sources includes a light emitting diode (LED) array.

13. A light source for an image forming apparatus operable on electrophotography, comprising:

an array including a plurality of light-emitting elements, which are subject to individual luminous controls, respectively; and a beam control element to restrict in cross sectional area and profile of a beam of light emitted by each of said plurality of light-emitting elements.

14. The light source as claimed in claim 13, wherein said beam control element includes a light-shading mask.

15. The light source as claimed in claim 14, wherein said beam control element includes a micro lens.

16. The light source as claimed in claim 13, wherein said beam control element includes an array of optical fiber lenses associated with said light-emitting elements, respectively.

17. The light source as claimed in claim 16, wherein said beam control element includes a light-shading mask.

18. The light source as claimed in claim 16, wherein said beam control element includes a micro lens.

19. An image forming apparatus operable on a Carlson process elecrophotography, comprising:

a photoconductive unit; and a light source including an array including a plurality of light-emitting elements, which are subject to individual luminous controls, respectively; and a beam control element to restrict in cross sectional area and profile of a beam of light emitted by each of said plurality of light-emitting elements.

20. An image forming apparatus comprising:

a porous photosensitive unit, said porous photosensitive unit including a substrate, a conductive layer formed on a surface of said substrate;

a photoconductive layer formed on a surface of said conductive layer;

a porous insulating layer formed on a surface of said photoconductive layer, said porous insulating layer having a plurality of holes for holding conductive color particles, said plurality of holes exposing a plurality of surface portions of the surface of said photoconductive layer, respectively;

an electrode formed on a surface of said porous insulating layer except where said plurality of holes are formed; and restrainer means whereby an optical arrangement is provided, in which, when a light source corresponding to a desired one of said plurality of holes emits light to cause conductive color particles to fly out of said desired hole only, said light exposes a region, within said photoconductive layer, which substantially coextends with the surface portion that is exposed by said desired hole;

a plurality of light sources corresponding to said plurality of holes, respectively;

means for supplying conductive color particles to said porous photosensitive unit and holding the conductive color particles in said plurality of holes; and a recording medium;

said plurality of light sources being adapted to emit light to cause at least one of said plurality of holes to allow the conductive color particles to fly out of the hole toward said recording medium;

each of said plurality of light sources including an array including a plurality of light-emitting elements, which are subject to individual luminous controls, respectively; and a beam control element to restrict in cross sectional area and profile of a beam of light emitted by each of said plurality of light-emitting elements.

21. The image forming apparatus as claimed in claim 20, wherein said beam control element includes a light-shading mask.

22. The image forming apparatus as claimed in claim 21, wherein said beam control element includes a micro lens.

23. The image forming apparatus as claimed in claim 21, wherein said substrate and said conductive layer are transparent with respect to the light from said plurality of light sources to allow passage of light, and wherein said restrainer means include a masking layer that absorbs the light from the plurality of light sources except a plurality of light transparent portions corresponding to said plurality of holes, respectively, said plurality of light transparent portions allowing passage of the light from the plurality of light sources.

24. The image forming apparatus as claimed in claim 21, wherein said restrainer means include said substrate, said substrate absorbs the light from the plurality of light sources except a plurality of light transparent portions corresponding to said plurality of holes, respectively, said plurality of light transparent portions allowing passage of the light from the plurality of light sources.

25. The image forming apparatus as claimed in claim 21, wherein said restrainer means include light gathering means for gathering the light from the plurality of light sources at said region.

26. The image forming apparatus as claimed in claim 21, wherein said restrainer means include a plurality of lenses corresponding to said plurality of holes, respectively, and each of said plurality of lenses having a diameter larger than a diameter of the corresponding one of said plurality of holes for gathering light at the surface portion that is exposed by the corresponding one hole.

27. The image forming apparatus as claimed in claim 20, wherein said beam control element includes an array of optical fiber lenses associated with said light-emitting elements, respectively.

28. The image forming apparatus as claimed in claim 27, wherein said beam control element includes a light-shading mask.

29. The image forming apparatus as claimed in claim 27, wherein said beam control element includes a micro lens.

30. The image forming apparatus as claimed in claim 27, wherein said substrate and said conductive layer are transparent with respect to the light from said plurality of light sources to allow passage of light, and wherein said restrainer means include a masking layer that absorbs the light from the plurality of light sources except a plurality of holes, respectively, said plurality of light transparent portions allowing passage of the light from the plurality of light sources.

31. The image forming apparatus as claimed in claim 27, wherein said restrainer means include said substrate, said substrate absorbs the light from the plurality of light sources except a plurality of light transparent portions corresponding to said plurality of holes, respectively, said plurality of light transparent portions allowing passage of the light from the plurality of light sources.

32. The image forming apparatus as claimed in claim 27, wherein said restrainer means include light at said region.

33. The image forming apparatus as claimed in claim 27, wherein said restrainer means include a plurality of lenses corresponding to said plurality of holes, respectively, and each of said plurality of lenses having a diameter larger than a diameter of the corresponding one of said plurality of holes for gathering light at the surface portion that is exposed by the corresponding one hole.

* * * * *

UNITED STATES PATENT AND TRADEMARK OFFICE

CERTIFICATE OF CORRECTION

PATENT NO. : 6,275,673 B1
DATED : August 14, 2001
INVENTOR(S) : Tomoyuki Yoshii et al.

It is certified that error appears in the above-identified patent and that said Letters Patent is hereby corrected as shown below:

Column 5,
Lines 16, 17, 20, 23, 32 & 53, “protrusion” should read -- protrusions --

Column 6,
Line 27, “portions” should read -- protrusions --

Column 7,
Lines 20, 36 & 60, “protrusion” should read -- protrusions --

Column 8,
Lines 13 & 20, “protrusion” should read -- protrusions --

Column 9,
Line 37, “protrusion” should read -- protrusions --

Signed and Sealed this

Twenty-first Day of January, 2003

JAMES E. ROGAN
*Director of the United States Patent and Trademark Office*